US006164505A

United States Patent [19]

Holter et al.

[11] Patent Number: 6,164,505

[45] Date of Patent: Dec. 26, 2000

[54] HARNESS FOR CARRYING A RIGID CASE

[76] Inventors: Dean S. Holter; Hether L. Holter, both of 34 Bella Vista Ave., San Anselmo, Calif. 94960

[21] Appl. No.: 09/064,812

[22] Filed: Apr. 22, 1998

[51] Int. Cl.[7] ..... A45F 3/04

[52] U.S. Cl. ..... 224/259; 224/260; 224/262; 224/629; 224/638; 224/640

[58] Field of Search ..... 224/259, 250, 224/638, 640, 644, 642, 629, 153, 657, 260, 261, 262

[56] References Cited

U.S. PATENT DOCUMENTS

| | | | |
|---|---|---|---|
| 995,458 | 6/1911 | Harriman | 224/651 |
| 3,995,802 | 12/1976 | Johnston | 224/629 |
| 4,790,460 | 12/1988 | Harper, Jr. | 224/250 |
| 5,181,638 | 1/1993 | McHale | 224/259 |
| 5,632,429 | 5/1997 | Cantwell . | |
| 5,647,522 | 7/1997 | Routh | 224/250 |
| 5,810,223 | 9/1998 | Helm | 224/250 |

FOREIGN PATENT DOCUMENTS

| | | | |
|---|---|---|---|
| 1080903 | 4/1960 | Germany | 224/214 |

*Primary Examiner*—Gary E. Elkins
*Attorney, Agent, or Firm*—William L. Paradice, III

[57] ABSTRACT

A harness allows one to easily carry a rigid case through rough terrain and using almost any transportation mode includes a backpad releasably attached to the case and lying flush against one back. The harness includes at least one lower load strap for securing the case from below and at least one upper load strap for securing the case from above. In one embodiment, the harness includes shoulder straps adapted to extend over one's shoulder and stabilizer straps extending from the shoulder straps and releasably attached to the case to provide cant adjustment. The harness further includes a sternum strap adapted to extend around one's sternum and a diaphragm strap adapted to extend around one's waist. In another embodiment, the harness includes a waist strap adapted to extend around one's waist.

25 Claims, 12 Drawing Sheets

HARNESS FOR CARRYING A RIGID CASE

BACKGROUND

1. Field of Invention

This invention relates to outdoor packing and travel gear.

2. Description of Related Art

Advances in the semiconductor industry have enabled miniaturization of various electronic devices such as video cameras, cellular telephones, laptop computers, etc. The resultant increased portability, combined with continuing declines in price, have led to the present popularity of these electronic devices. Thus, while the size and expense of professional quality video cameras of a decade ago restricted portability and limited their use to television stations and film production companies, respectively, professional quality video cameras are now small enough to fit in one's hand and more affordable than ever. For instance, more than three and a half million camcorders were sold in the United States last year, thereby allowing millions to capture professional quality video in remote locations.

In response thereto, a market for rigid, hardshell protective cases that enable safe transport of these devices to remote locations has developed. One of the more popular protective cases is the Pelican Case, available from Pelican Products, Inc. of Torrance, Calif. Pelican Cases are available in a variety of sizes, ranging from a small case suitable for transporting a small camera or cellular phone (e.g., Pelican Case model 1150) to a large case suitable for transporting a large video camera or laptop computer (e.g., Pelican model 1500).

Referring to FIG. 1, a larger case 1 of the Pelican line (e.g., models 1400, 1450, or 1500) includes a lightweight, heavy-duty injection molded plastic shell 2 and lid 3, whereby the lid 3 forms a front surface of the case 1. An O-ring 4 within the lid 3 and a pressure purge valve 5 on the top surface of the case 1 prevents water, air, and debris from entering the case 1. The case 1 is waterproof and dustproof and, in addition, minimizes heat transfer between the interior and exterior thereof, thereby protecting contents held within the case 1 from environmental elements. A foam insert 6 provided within the case 1 is customized to provide a snug fit for a device (not shown) desired to be safely carried in the case 1. The foam insert 6 provides additional protection from external forces resulting from, for instance, the case 1 being dropped or stepped upon. The lid 3 is sealed to the shell 2 via two quick release latches 7 that allow fast and easy access to the contents of the case 1. The case 1 is carried using a handle 8 mounted on the top surface of the case 1. For clarity of reference to the case 1, the bottom surface is opposite the top surface, and the rear surface is opposite the front surface (the lid 3 forms the front surface), both adjoined by sides.

The protection afforded by the protective case 1 allows sensitive electronic devices to be safely transported in hostile environments. The case 1 can be dropped from heights of more than 100 feet, stepped on, submerged in up to thirty feet of water, buried in snow, and so on, without any resultant damage to the contents of the case, even where the contents include, for instance, a sensitive video camera. Thus, for instance, the Pelican Case allows an individual to safely transport a video camera to remote locations or to safely bring a cellular phone, camera, computer, GPS locator, etc. on a white-water rafting trip.

Although allowing for safe transport of sensitive electronic devices, the Pelican Case 1 is not easy to carry, especially in rough or unfamiliar terrain. The case 1 is designed to be carried using one hand in a manner similar to carrying a briefcase, i.e., by clutching the handle 8 with one's hand. Unfortunately, this not only requires the use of one hand, but also alters the center of gravity of the person carrying the case. As a result, the case 1 is not suitable for modes of transportation and/or terrains which require balance and/or the use of both hands. Indeed, it would be difficult to carry the case 1 while riding a bike, climbing a near-vertical rockface, snow skiing, traversing narrow mountain trails, etc. Accordingly, there is a long-felt but as of yet unsatisfied need to improve the ease with which protective cases of the type shown in FIG. 1 are carried.

SUMMARY

A harness is disclosed that removably attaches to a protective case to allow for the easy transport thereof. The harness includes a backpad to which is attached the protective case. The protective case is positioned adjacent the backpad, where the back surface of the case is flush with the backpad, and where the top surface, to which is attached the case's handle, is facing upward and substantially parallel with the ground. In a first embodiment of the present invention, the backpad front surface is approximately nine inches by nine inches and has attached thereto adjustable shoulder straps adapted to extend over the shoulders of a person so as to allow the harness to be worn on the back of the person in a manner similar to that of a conventional backpack. This harness also includes adjustable sternum and diaphragm straps to maximize comfort and stability. An adjustable upper load strap which loops through the case's handle secures a top portion of the case to the harness. Lower adjustable load straps extending from the backpad and removably attached to the bottom surface of the case secure the case from below. Adjustable stabilization straps extending from the shoulder straps and removably attached to the top surface of the case allow for cant and load adjustments, thereby further increasing comfort and stability.

In another embodiment of the present invention, the backpad front surface is smaller than that of the first embodiment and has attached thereto a belt strap adapted to extend around a person's waist, whereby the protective case is positioned adjacent the backpad as described above. Adjustable load straps extending from the backpad and looping through the handle of the protective case secure a top portion of the case to the harness. The load straps also removably attach to the bottom surface of the case secure the case to the harness from below.

By comfortably securing the protective case to one's back, present embodiments free both of one's hands and restore one's center of gravity, thereby maximizing one's balance and agility. Consequently, present embodiments allow such protective cases to be more easily transported through rough terrain and/or by modes of transportation previously infeasible when carrying the case in a conventional manner, i.e., when clutching the case's handle with one's hand.

Like components in the Figures are similarly labeled.

DETAILED DESCRIPTION

Principles of the present invention are described below with reference to Pelican protective cases for simplicity only. It is to be understood that embodiments of the present invention may be used with other types of rigid carrying cases available from other manufacturers. Accordingly, the present invention is not to be construed as limited to specific examples provided herein, but rather includes within its scope all those embodiments encompassed by the appended claims.

Figure 1:
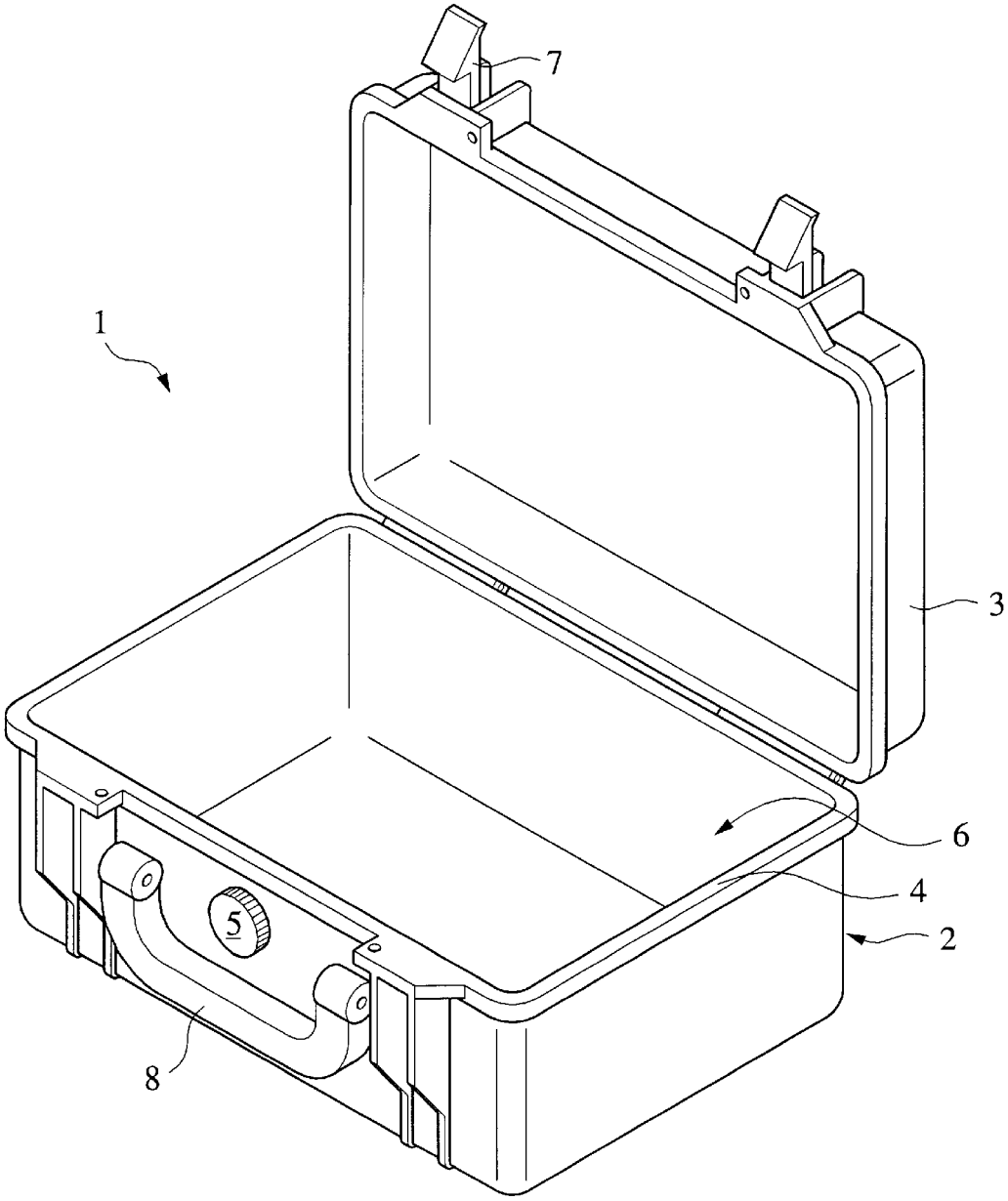
FIG. 1 is an elevated perspective view of a typical Pelican case.
Figure 2A:
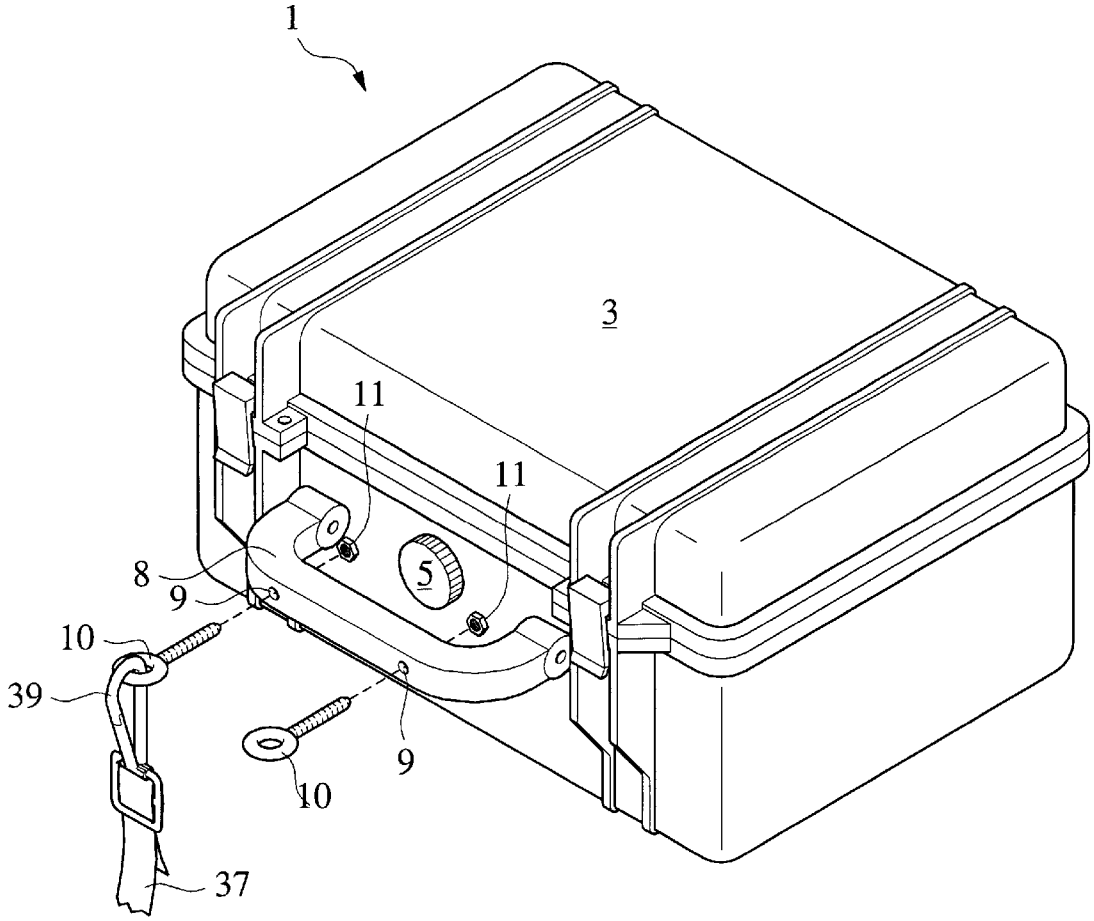
FIG. 2A is a top plan view of a larger Pelican case of FIG. 1, as modified in accordance with the present invention.
Figure 2B:
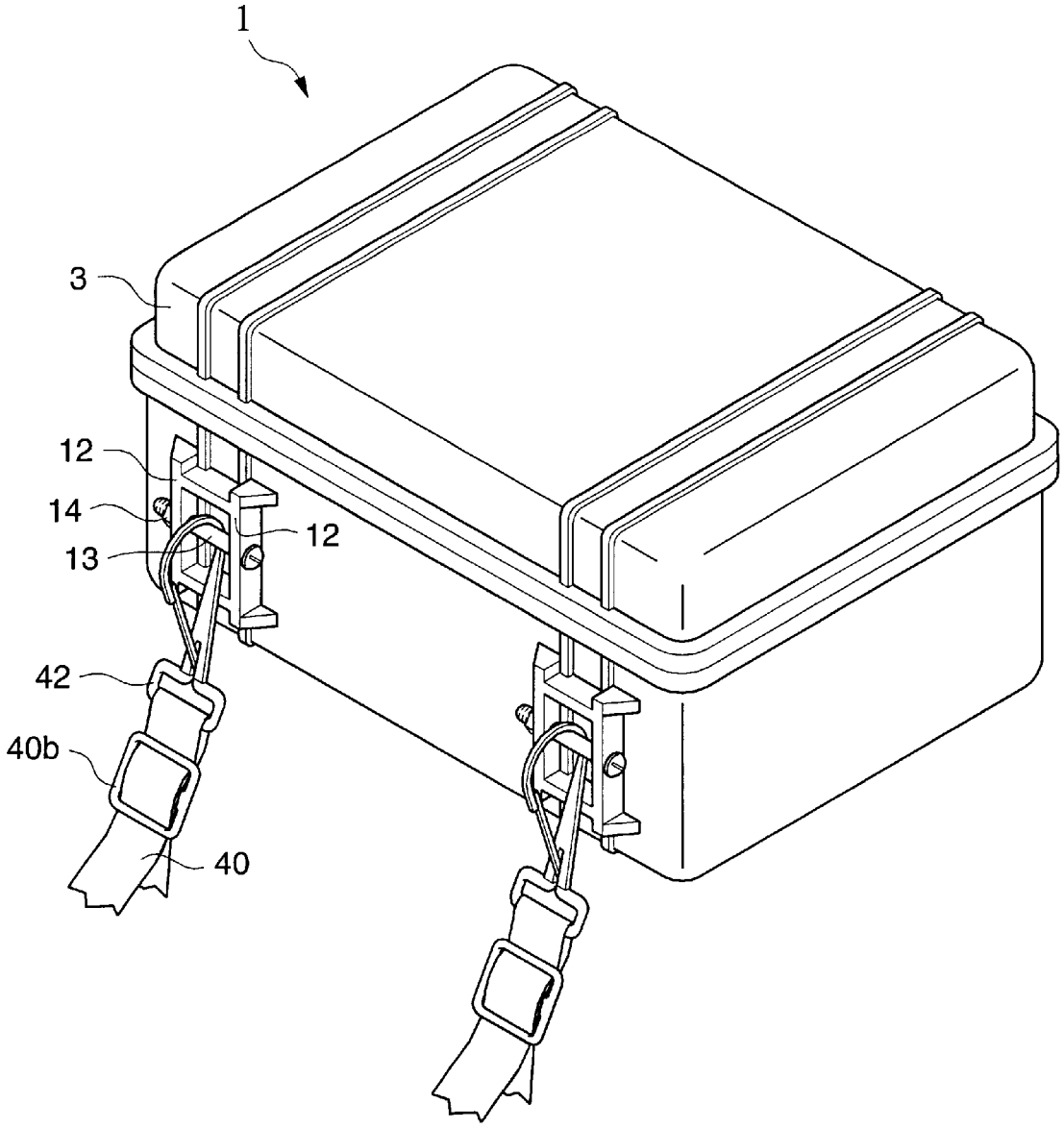
FIG. 2B is a bottom plan view of the Pelican case of FIG. 2A, as modified in accordance with the present invention.
Figure 3:
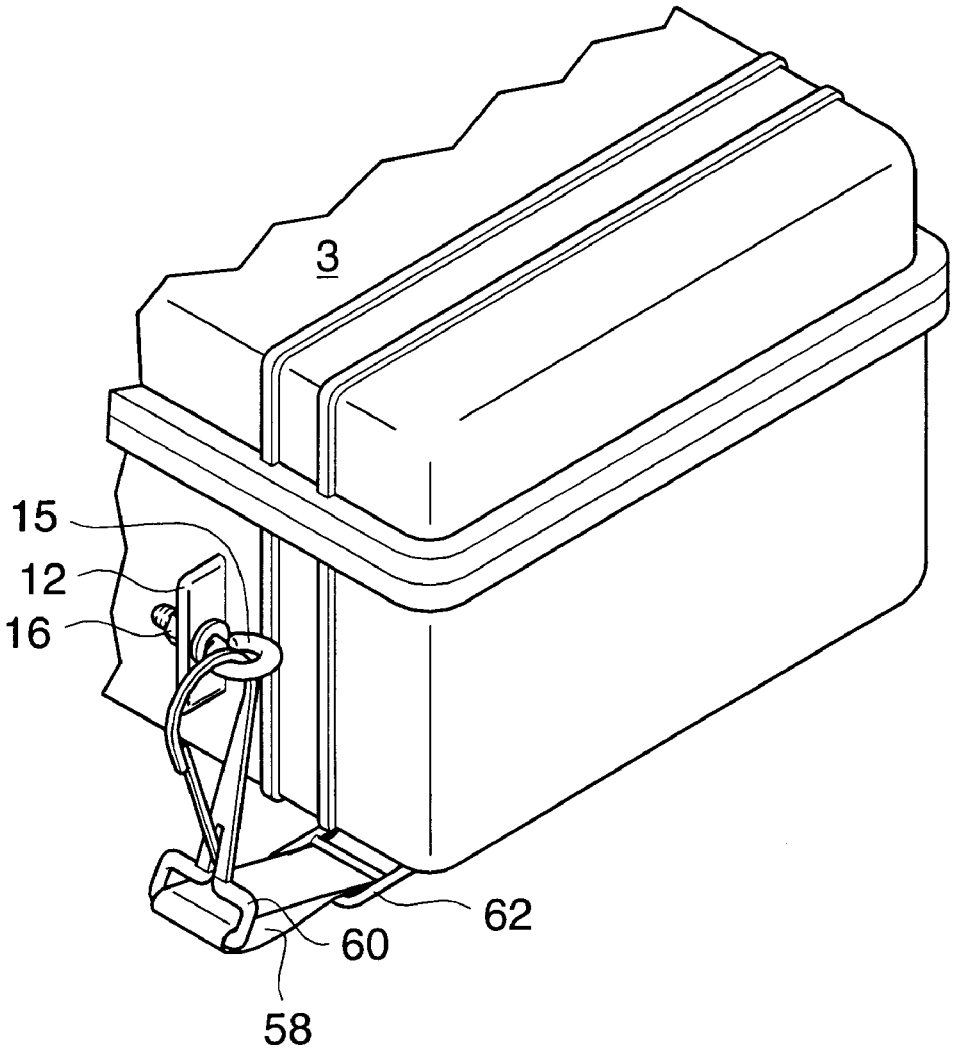
FIG. 3 is a bottom plan view of a smaller Pelican case of FIG. 1, as modified in accordance with the present invention.

Applicants note that use of present embodiments in carrying a protective case of the type shown in FIG. 1 requires slight modifications to the case. With respect to the larger Pelican cases, e.g., models 1400, 1450, 1500, and 1520, eye-bolts 10 are inserted through existing holes 9 in the handle 8 and securely fastened thereto with lock nuts 11, as shown in FIG. 2A. Small aligning holes approximately ⅜ of an inch in diameter are drilled in each of the existing fins 12 provided on the bottom surface of the case 1. Threaded bolts 13 are inserted through these holes so as to extend between each pair of fins 12, as shown in FIG. 2B, and secured with associated lock nuts 14. The smaller Pelican cases, e.g., models 1150 and 1200, have a slightly different fin configuration than do the larger Pelican cases. Here, ⅜" holes are drilled into each of the existing fins 12 on the bottom surface of the case, and then eye-bolts 15 inserted therethrough are secured with lock nuts 16, as shown in FIG. 3. Here, no modification is required to the handle.

Figure 4:
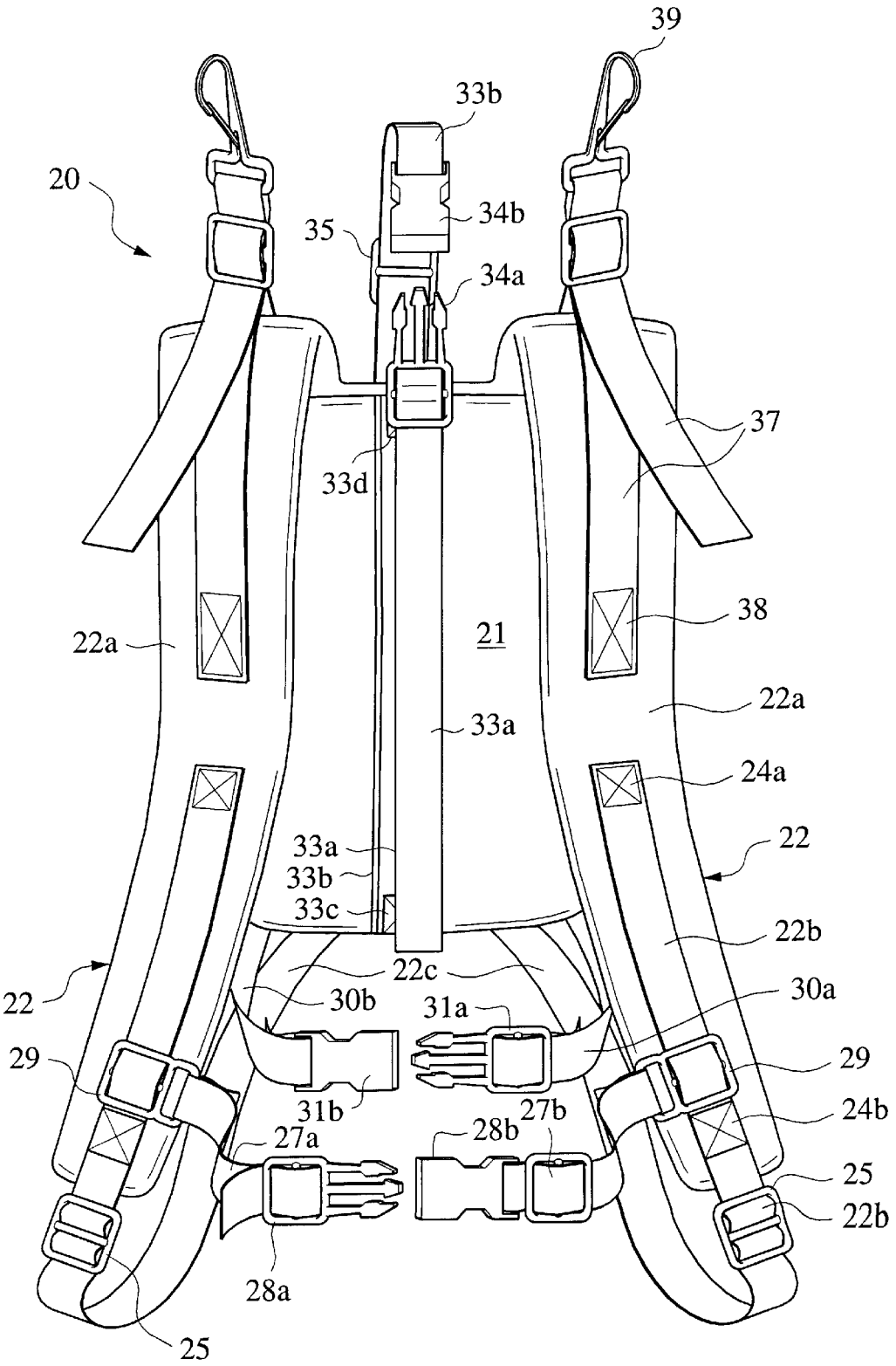
FIG. 4 is a rear perspective view of a harness in accordance with a first embodiment of the present invention.
Figure 5:
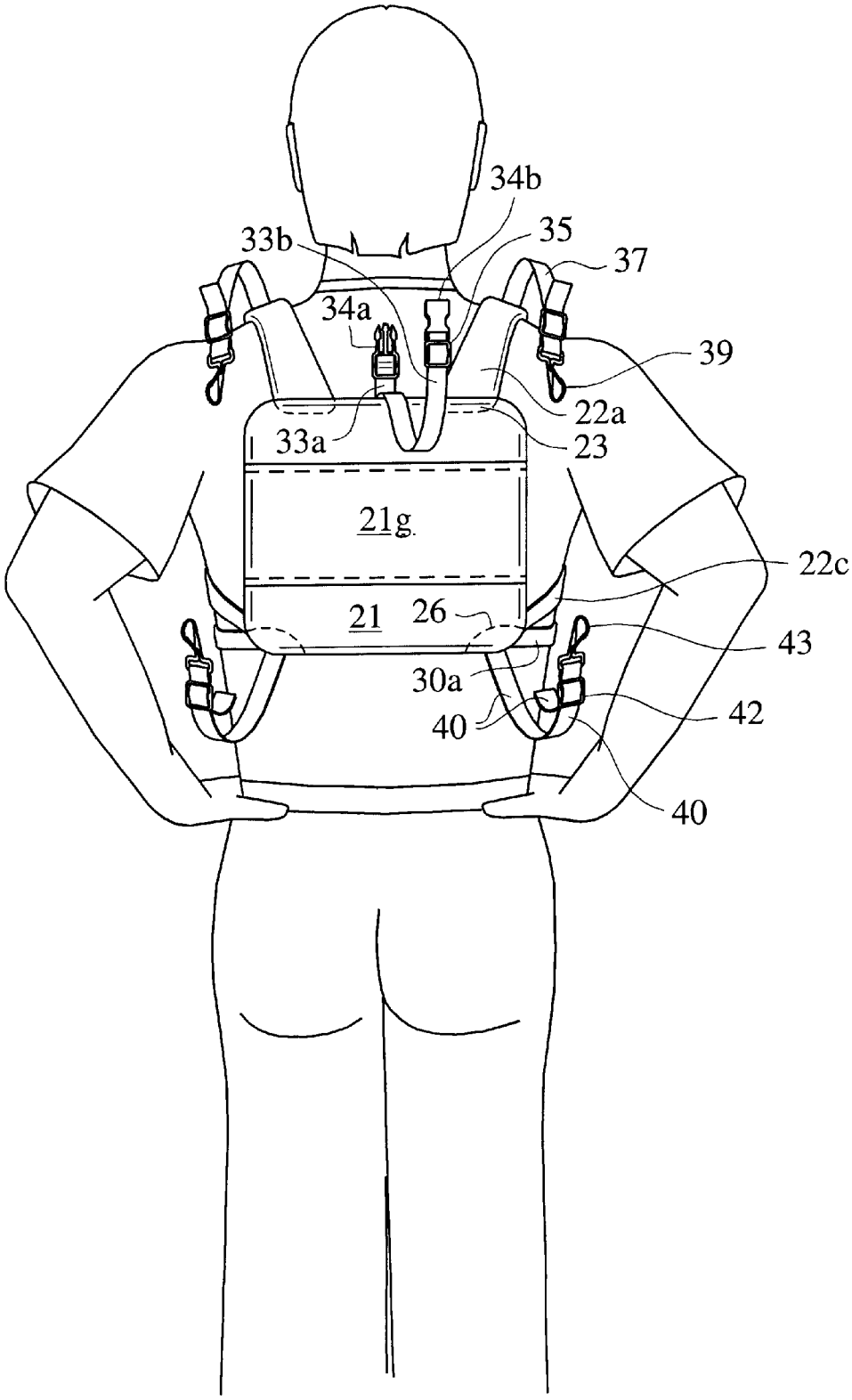
FIG. 5 is a front perspective view of the harness of FIG. 4 as worn by a person.

Referring to FIGS. 4–7, a backpack-type harness 20 includes a backpad 21 constructed of high density foam and encased by a suitable durable fabric such as, for instance, Nylon Cordura, although other suitable encasing materials such as leather may be used. In a preferred embodiment, the backpad 21 has a length and height of approximately nine inches and a thickness of approximately one to two inches. The rear surface of the backpad rests against a person's back (FIG. 4), while the front surface of the backpad abuts the rear surface of the case 1 (FIG. 5). The backpad 21 is preferably fabricated from multiple sheets of material joined together as by stitching, although a single, unitary sheet of material may be used. Preferably, a strip of rubberized grip cloth 21*g* such as, for instance, Tacliner, is provided on the front surface of the backpad 21 to increase the coefficient of friction between the case 1 and the backpad 21 and thereby minimize slippage of the case 1 with respect to the harness 20.

The harness 20 includes a pair of shoulder straps 22 adapted to extend over the shoulders of a person wearing the harness 20 (FIGS. 4–7). The shoulder straps 22 include padded upper strap members 22*a*, middle strap members 22*b*, and lower strap members 22*c*. The padded upper shoulder strap members 22*a* have first ends permanently attached to an upper portion of the backpad 21 via stitching 23 (FIG. 5). The middle strap members 22*b* have first ends permanently attached to a middle section of the padded upper strap members 22*a* via stitching 24*a* (FIG. 4). The second ends of the middle strap members 22*b* are permanently fastened to respective buckles 25 and are permanently attached to respective second ends of the padded upper strap members 22*a* via stitching 24*b*. The lower strap members 22*c* have first ends permanently attached to a lower portion of the backpad 21 via stitching 26 (FIG. 5) and have second ends which loop through respective buckles 25 (FIG. 4). The buckles 25, which are preferably Fastex® Ladderloc™ buckles, allow the length of the shoulder straps 22 to be adjusted for comfort and stability.

A sternum strap 27 having first and second sections 27*a* and 27*b* is adapted to releasably attach around a person's sternum using a one-inch side-release buckle 28 having male and female sections 28*a* and 28*b*. The sternum strap sections 27*a* and 27*b* have first ends permanently attached to respective fasteners 29 which, in turn, are slidably attached to respective middle strap members 22*b* of the shoulder straps 22. The fasteners 29, which in preferred embodiments include a DEE-type portion coupled to the sternum strap 27 and a Fastex® Tri-Glide™ slide portion coupled to the middle shoulder strap section 22*b*, allow the sternum strap 27 to slide in a substantially vertical direction along middle strap members 22*b* between respective stitchings 24*a* and 24*b*. The second end of the first sternum strap section 27*a* adjustably slides through a threaded portion of the male section 28*a* of the buckle 28, and the second end of the second sternum strap section 27*b* is permanently attached to the female section 28*b* of the buckle 28. The threaded portion of the male section 28*a* of the buckle 28 is preferably similar in construction to that of the Fastex® Tri-Glide™ buckle. The adjustability of the sternum strap 27, as provided by the threaded portion of the buckle 28 and the DEE-type fasteners 29, allows the sternum strap 27 to snugly extend across the sternum of persons of varying sizes.

A diaphragm strap 30 having first and second sections 30*a* and 30*b* is adapted to releasably attach around a person's waist using a one-inch side-release buckle 31 having male and female sections 31*a* and 31*b*. The diaphragm strap sections 30*a* and 30*b* have first ends permanently attached to respective opposite sides of the backpad 21 via stitching 26 (FIG. 5). The second end of the first sternum strap section 30*a* adjustably slides through a threaded portion (not shown for simplicity) of the male section 31*a* of the buckle 31, and the second end of the second sternum strap section 30*b* is permanently attached to the female section 31*b* of the buckle 31 (FIG. 4). The threaded portion of the male section 31*a* of the buckle 31 is preferably similar in construction to that of the Fastex® Tri-Glide™ buckle. The adjustability of the diaphragm strap 30, as provided by the threaded portion of the buckle 31, allows the diaphragm strap 30 to snugly extend around the waist of persons of varying sizes.

A load strap 33 is adapted to loop through the handle 8 of the case 1 using a side-release buckle 34 having male and female sections 34*a* and 34*b*. The load strap 33 includes first and second sections 33*a* and 33*b* having first ends anchored to a lower portion of the rear backpad panel 21*r* via stitching 33*c* and middle portions anchored to an upper portion of the rear backpad panel 21*r* via stitching 33*d*. The portion of the load strap section 33*a* lying between stitching 33*c* and 33*d* overlaps a corresponding portion of the load strap section 33*b*, where these respective portions of load strap sections 33*a* and 33*b* are preferably sewn together and to the backpad 21 along the entire height of the backpad 21. The second end of the load strap portion 33*a* adjustably slides through a threaded portion of the male buckle section 34*a*, and the second end of the other load strap section 33*b* slides through a buckle 35, loops through a threaded portion of the female buckle 34*b*, and adjustably slides back through the buckle 35 to allow the length of the upper load strap 33 to be adjusted for stability and for varying sizes of the case 1. The buckle 35 is preferably a Fastex® T-Glide™ buckle. The threaded portion of the male section 34*a* of the buckle 34, preferably similar in construction to that of the astex® Tri-Glide™ buckle, allows the load strap 33 to be suitably tightened at the first end thereof to secure the case The harness 20 also includes stabilizer straps 37 to provide cant adjustments. The stabilizer straps 37 have first ends permanently attached to the respective padded upper shoulder strap sections 22*a* via stitching 38 and second ends which adjustably slide through respective threaded portions of respective fasteners 39. The fasteners 39, which in preferred embodiments are Fastex® interlocking snap-hook clips, are adapted to releasably attach to the eye-bolts 10 secured to the handle 8 of the case 1.

Lower load straps 40 are provided to secure the case 1 to the harness from below (FIG. 5). The lower load straps 40 have first ends permanently attached to the backpad 21 via stitching 26 and second ends which slide through buckles 42, loop through threaded portions of respective fasteners 43, and adjustably slide back through the buckles 42 to allow for the length of the lower load straps 40 to be adjusted for stability. The fasteners 43 are adapted to releasably attach to the bolts 13 secured the bottom surface of the case 1. In preferred embodiments, the buckles 42 are Fastex® T-Glide™ buckles and the fasteners 43 are Fastex interlocking snap-hook clips.

Figure 6:
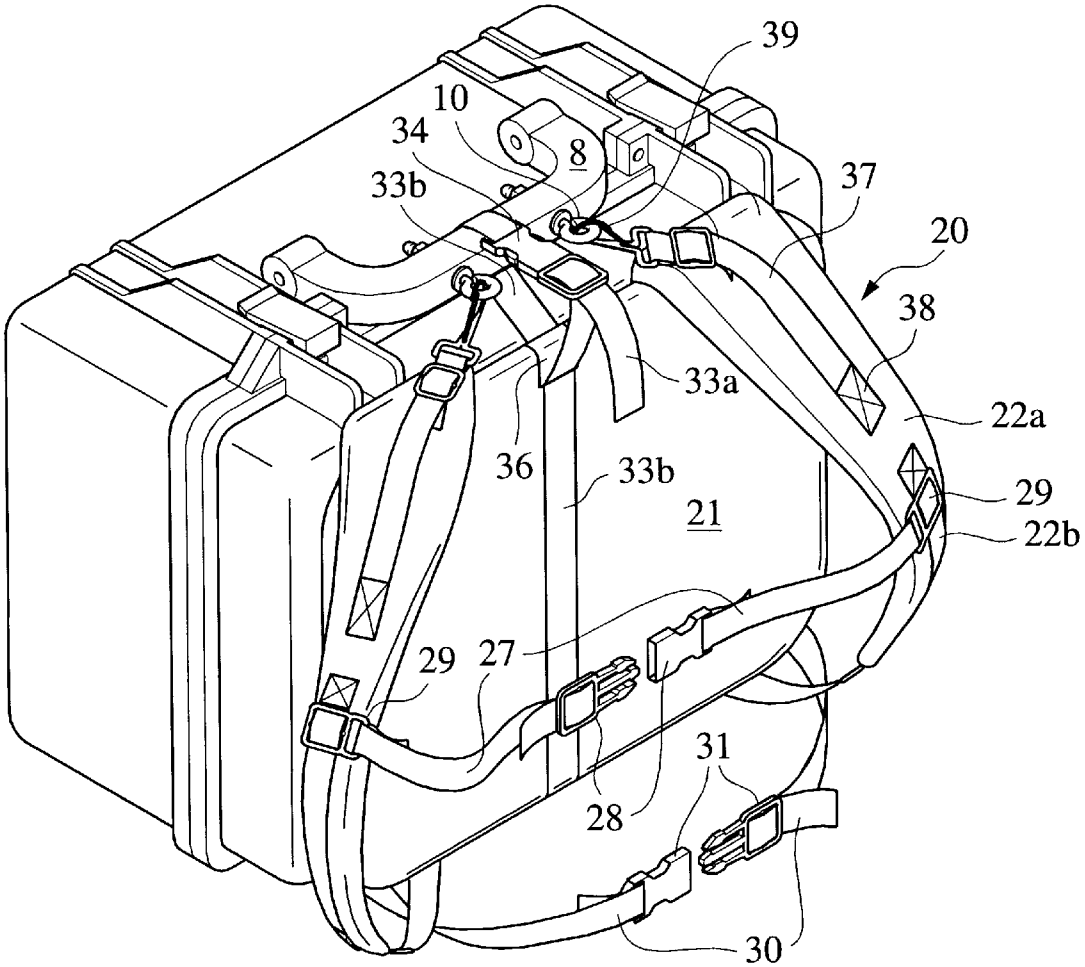
FIG. 6 is a perspective view of the harness of FIG. 4 having a protective case of the type shown in FIGS. 2A and 2B attached thereto.

To secure the case 1 to the harness 20, the load strap section 33*b* is looped through the handle 8 of the case 1, releasably attached to the load strap section 33*a* by interlocking the male and female sections of the side-release buckle 34, and suitably tightened by firmly pulling on the load strap section 33*b*, as shown, for instance, in FIG. 6. The snap-hook clips 39 are releasably clipped to respective eye-bolts 10 affixed to the handle 8 of-the case 1, thereby connecting the stabilizer straps 37 to the case 1 (FIGS. 2A and 4). The stabilizer straps 37 are suitably tightened for load and cant adjustments, so as to maintain proper orientation and load distribution of the case 1 and thereby maximize comfort and stability, by firmly pulling the free ends of the stabilizer straps 37. The fasteners 43 are releasably clipped to the bolts 13 affixed to the bottom surface of the case 1 so as to connect the lower load straps 40 to the case 1. The lower load straps 40 are suitably tightened by firmly pulling the free ends thereof through respective closures 42. Preferably, the lower load straps 40 are suitably tightened before the case 1 is attached to the harness 20.

Figure 7:
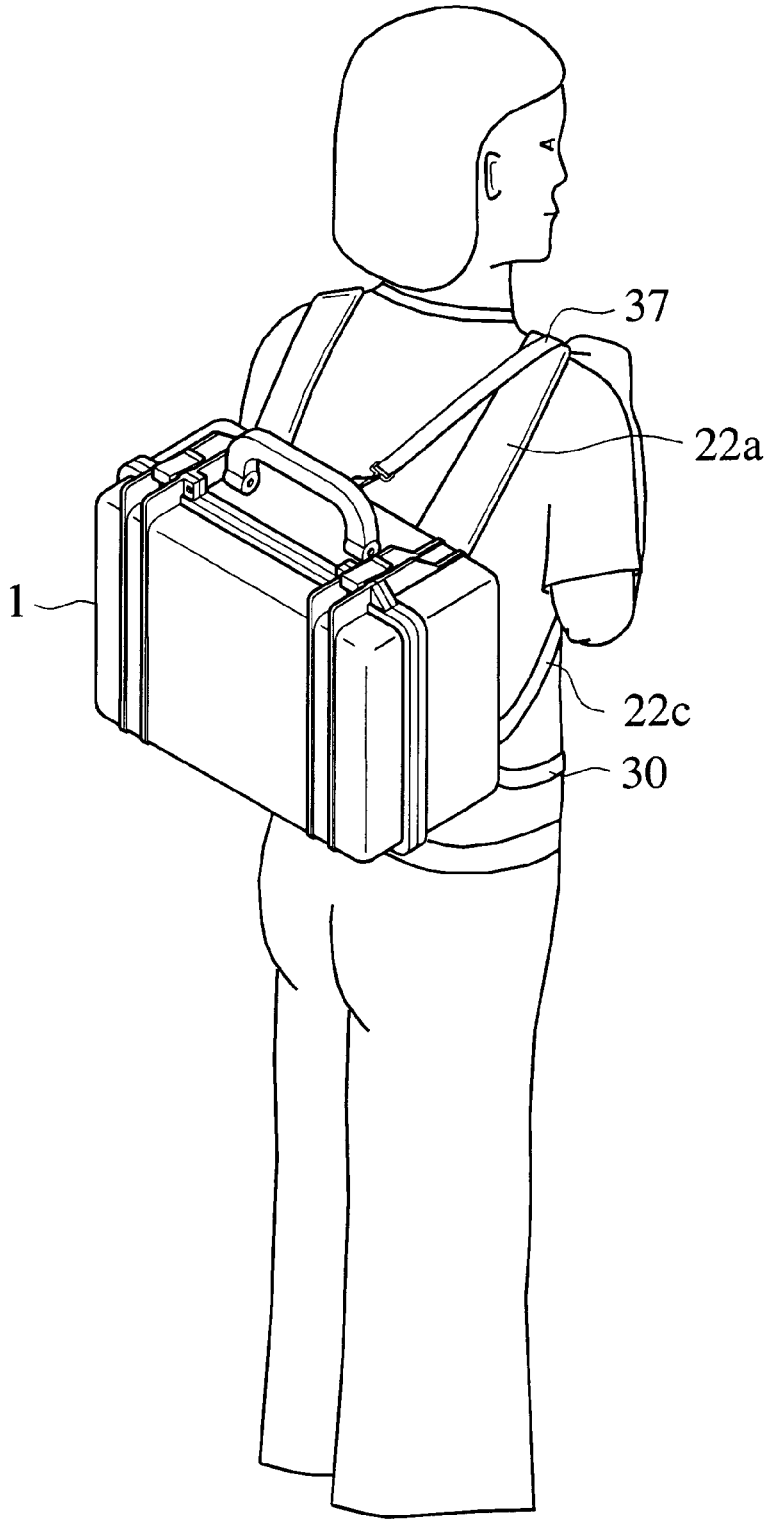
FIG. 7 is a perspective view of a person wearing the harness of FIG. 4 with a protective case of the type shown in FIGS. 2A and 2B attached thereto.

When the case 1 is secured to the harness 20 as described above, the harness 20 and case 1 may be quickly loaded onto the back of a person and worn as shown, for instance, in FIG. 7. As mentioned above, the cant of the case 1 is controlled by adjusting the effective length of the stabilizer straps 37, preferably such that the rear surface of the case 1 is flush with the backpad 21 which, in turn, is flush with the person's back. Thus, with the shoulder straps 22, sternum strap 27, diaphragm strap 30, upper load straps 33, and lower load straps 40 all suitably tightened for comfort and stability as described above, the harness 20 and its attached case 1 are firmly secured against a person's back, thereby freeing both hands and maintaining one's center of gravity and balance.

The above-described features of the present invention allow one to transport the case 1 and its contents across virtually any terrain and by various modes of transportation, many of which would not be feasible without the present invention. For instance, present embodiments allow a sensitive camera contained within the case 1 to be safely and easily transported while a person is rock-climbing, snow skiing, cycling, rafting, or skating. Such activities are nearly impossible without present embodiments, i.e., where the case 1 is carried in a conventional manner by clutching the handle 8 with one's hand. Accordingly, present embodiments greatly increase the portability of devices susceptible to water damage, temperature variations, breakage, or which are otherwise fragile. Further, present embodiments do not impede access to the contents of the case 1. Thus, referring to FIG. 7, the case 1 may be quickly opened as normal by lifting the quick-release buckles 7 and pulling open the lid 3, even while the case 1 is carried on a person's back. Thus, present embodiments allow sensitive equipment to be safely and easily transported to remote locations without compromising quick access to the contents of the case 1. Present embodiments are ideal, for example, for photographing wildlife in a rain forest, or filming a white-water rafting tour in the remote regions of Nepal, since a camera or video recorder can be safely and easily transported using the harness 20, and then almost instantly removed from the case 1 without having to take the harness off the person's back or detach the case from the harness.

Figure 8:
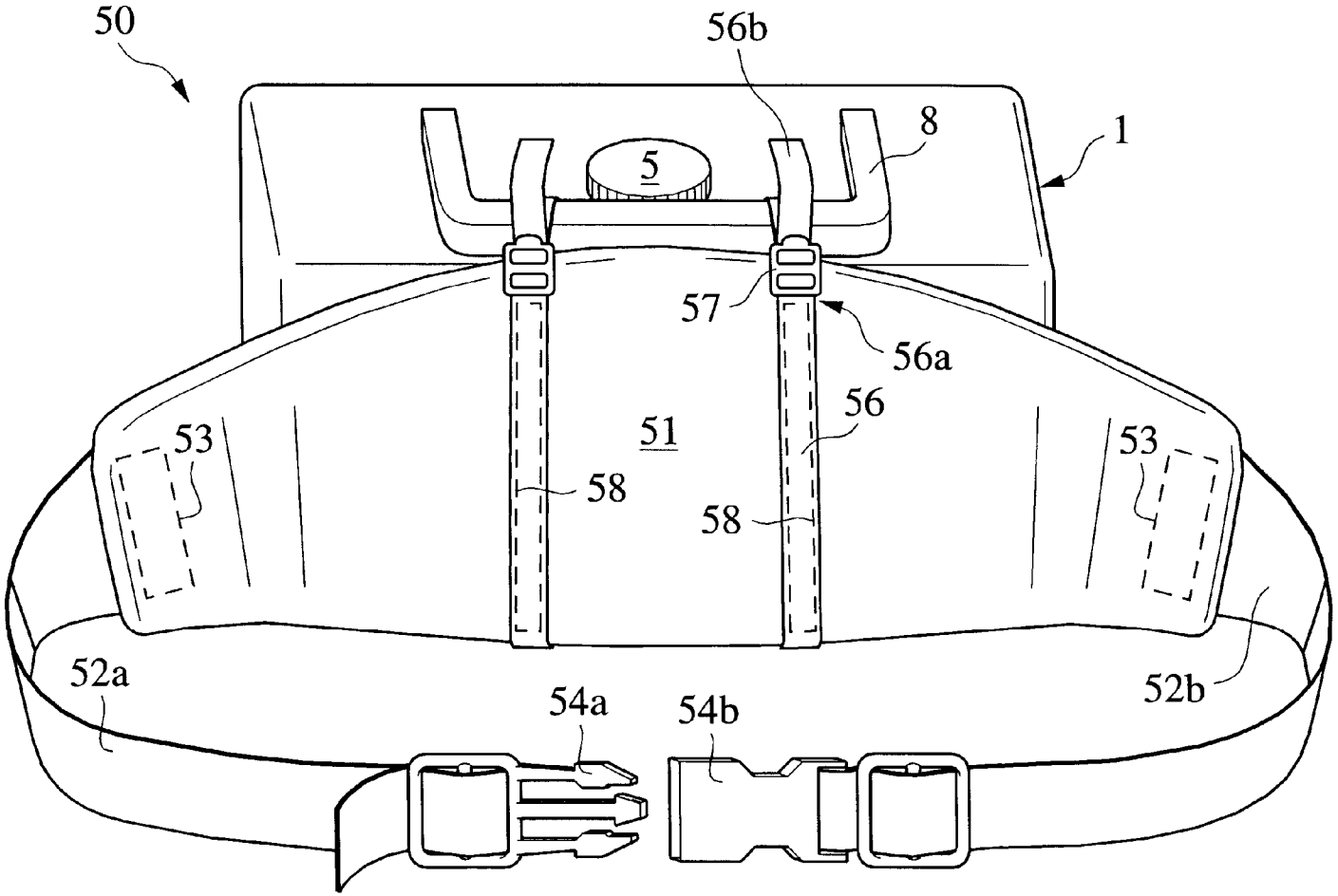
FIG. 8 is a rear perspective view of a harness having a protective case of the type shown in FIG. 3 attached thereto in accordance with a second embodiment of the present invention.
Figure 9:
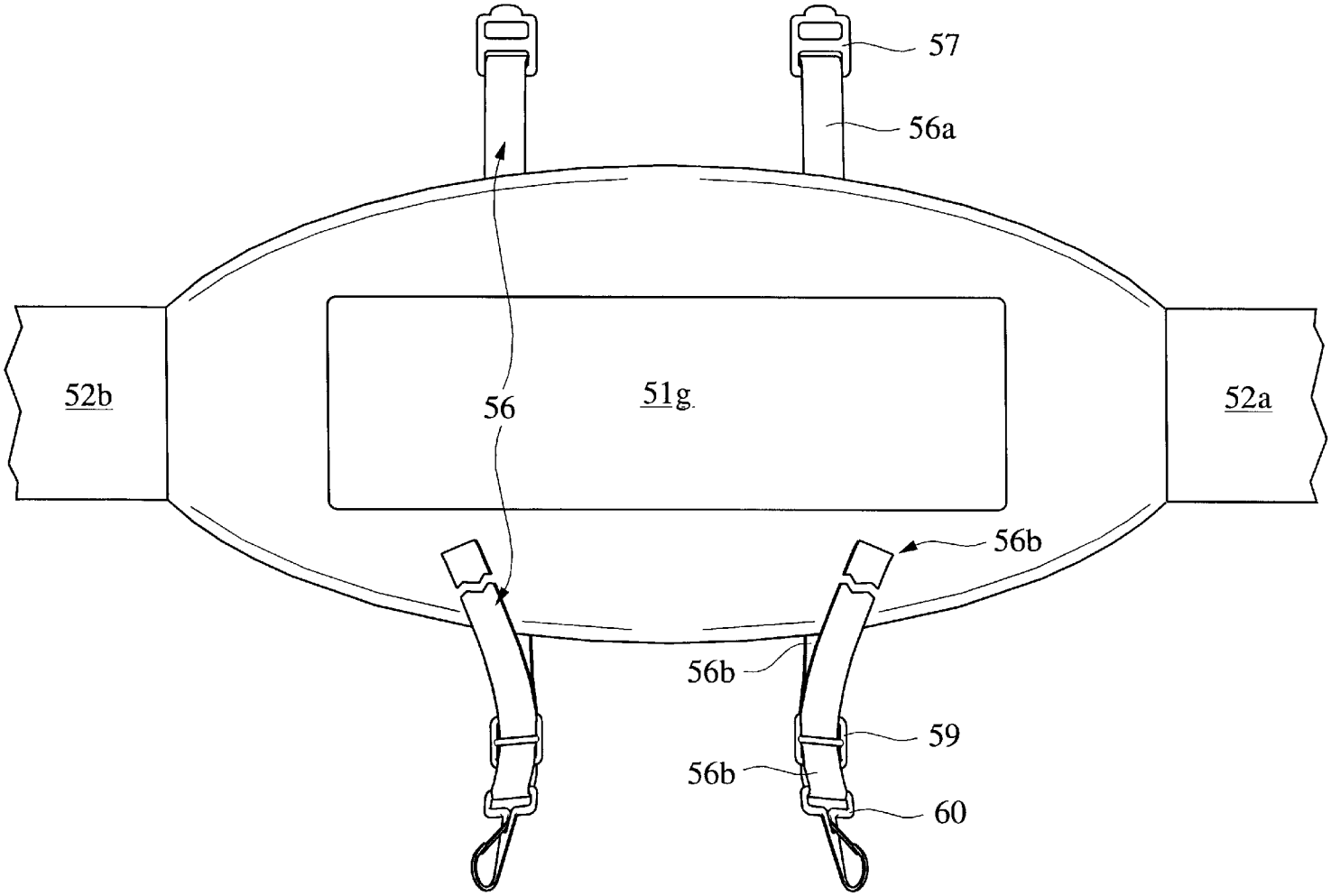
FIG. 9 is a front perspective view of the harness of FIG. 8.

The above-described backpack-type harness 20 may not be suitable for carrying smaller protective cases such as, for instance, Pelican Case models 1120, 1150, 1200, and 1300. Therefore, in accordance with another embodiment of the present invention, a fannypack-type harness 50 is disclosed for use with smaller rigid cases. Referring to FIG. 8, the harness 50 includes a backpad 51 constructed of high density foam and encased by a suitable durable fabric such as, for instance, Nylon Cordura, although other suitable encasing materials such as leather may be used. In a preferred embodiment, the backpad 51 is of a length and width of approximately nine inches by six inches and is approximately one inch thick. The rear surface of the backpad 51 rests against a person's lower back, while the front surface of the backpad 51 rests against the case 1 (FIG. 9). The backpad 51 is preferably fabricated from multiple sheets of material joined together as by stitching, although a single, unitary sheet of material may be used. The backpad 51 is tapered at each end so that the backpad 51 is approximately 2 inches wide at the ends thereof. Preferably, the front surface of the backpad 51 includes a strip of rubberized grip cloth 51g such as Tacliner to minimize slippage of the case 1 with respect to the harness 50.

A belt strap 52 and associated fastener 54 having male and female sections 54*a* and 54*b* are adapted to extend around the waist of a person (FIG. 8). The belt strap 52 includes first and second sections 52*a* and 52*b* having respective first ends permanently attached to opposite tapered portions of the backpad 51 via stitching 53 (FIG. 9). The second end of the first belt strap section 52*a* adjustably slides through a threaded portion of the male fastener section 54*a*, and the second end of the second belt strap section 52*b* is permanently attached to the female fastener section 54*b*. In preferred embodiments, the belt strap 52 is. constructed from heavy-duty nylon webbed strapping and the fastener 54 is a two-inch Fastex® side-release buckle. In some embodiments, the second belt strap section 52*b* adjustably slides through a threaded portion (not shown for simplicity) of the female fastener section 54*b*.

Load straps 56 having first ends 56*a* permanently attached to respective buckles 57 are anchor-sewn to the backpad 51 along the rear surface thereof via stitching 58. The load strap 56 extends through a fastener 59, loops through a threaded portion of a fastener 60, and adjustably slides back through the fastener 59. In preferred embodiments, the fasteners 57 are Fastex® Ladderloc™ buckles, the fasteners 59 are Fastex® T-Glide™ buckles, and the fasteners 60 are Fastex® interlocking snap-hook clips. The second ends 56*b* of the load straps 56 are adapted to adjustably slide through second threaded portions of respective fasteners 57. In other embodiments, where it is desired to carry an unusually heavy load using the harness 50, lumbar adjustment straps (not shown for simplicity) are provided.

Figure 10:
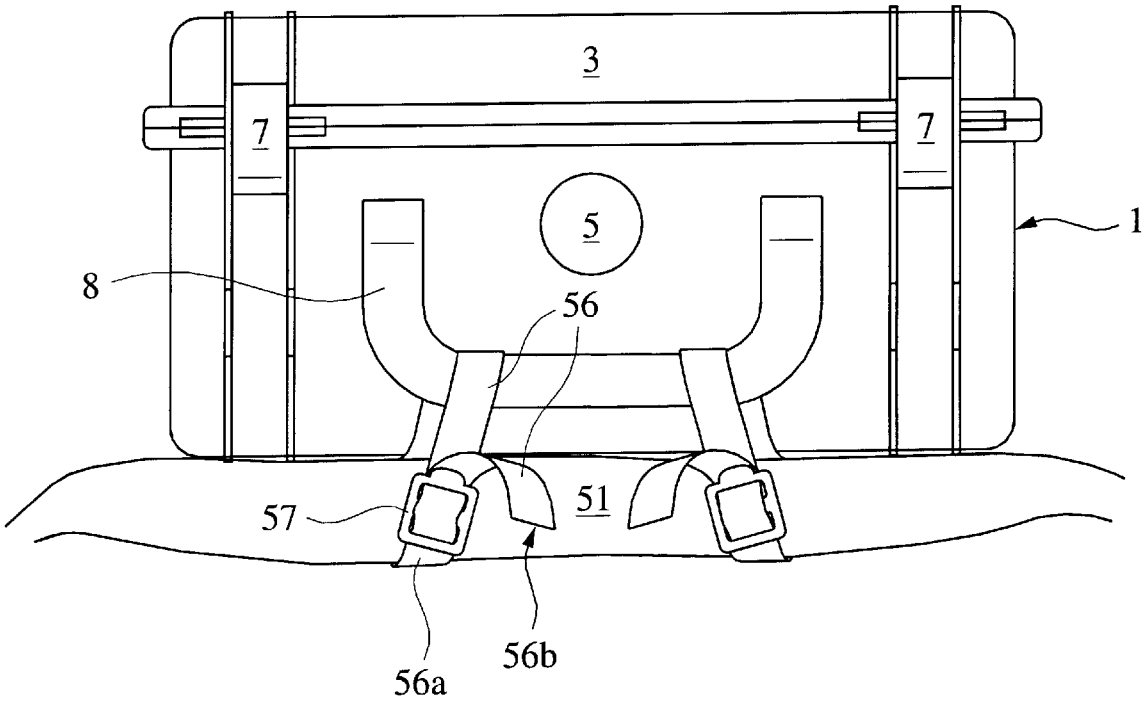
FIG. 10 is a top plan view of the harness of FIG. 8 having a protective case of the type shown in FIG. 3 attached thereto.

To secure the case 1 to the harness 50, the second ends 56*b* of the load straps 56 are looped through the handle 8 of the case 1, threaded through the buckles 57, and suitably tightened for comfort and stability, as shown in FIGS. 8 and 10. The snap-hook clips 10 are releasably clipped to the eye-bolts 15 secured to the bottom surface of the case 1, thereby connecting the load straps 56 to the bottom of the case 1, as shown in FIG. 3.

Figure 11:
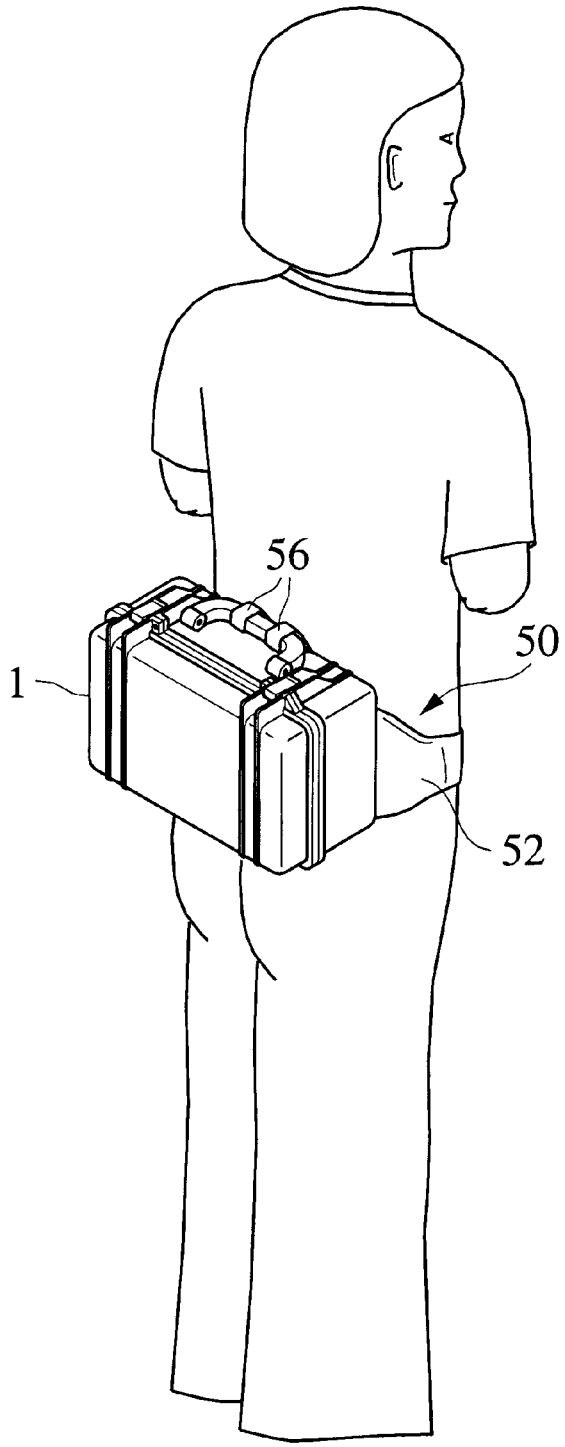
FIG. 11 is a perspective view of a person wearing the harness of FIG. 8 while transporting a protective case of the type shown in FIG. 3.

Once the case 1 is secured to the harness 50 as described above, the harness 50 and its attached case may be quickly mounted on a person by extending the belt strap 52 around the waist of a person, interlocking the male and female sections of the buckle 54, and suitably tightening the belt strap 52 for comfort and stability by firmly pulling on the free end of the belt strap section 52*a*, as shown, for instance, in FIG. 11. The harness 50 realizes all of the advantages discussed above with respect to the harness 20 and, thus, discussion of those advantages is not repeated here.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention. Fastening means and materials other than those mentioned above may be used without departing from the scope of the claims. For instance, the snap-hook clip fasteners described above may be replaced with karabiners, DEE-rings, or even with knotted loops of heavy-duty nylon cord. Further, the size and dimensions of the backpads discussed herein are merely illustrative. In other embodiments, the backpads may be of other suitable size and dimension, as required for particular applications. Further, although all of the above-mentioned straps are preferably made of nylon, other suitable durable material may be used.

We claim:

1. A pack harness allowing a person to carry a rigid case without requiring use of either of said person's hands, said harness comprising:

a backpad having a front surface and a rear surface opposite said front surface;

means for releasably securing said rigid case to said harness whereby a rear surface of said case substantially abuts and is substantially flush with said front surface of said backpad, said means for releasably securing said rigid case comprising one or more first load straps each having a first end connected to the backpad and a second end for releasably connecting to a bottom surface of said rigid case and comprising a second load strap having a first end connected to the bal-kpad and a second end for releasably connecting to a top surface of said rigid case, wherein said case may be easily opened to allow access to contents therein while secured to said harness; and means for attaching said harness and its secured case to a person whereby said rear surface of said backpad is substantially flush with and substantially abuts said person's back.

2. The harness of claim 1, wherein said means for attaching comprises a pair of shoulder straps adapted for extending over said person's shoulders, said shoulder straps having first ends attached to an upper portion of said backpad and second ends attached to a lower portion of said backpad.

3. The harness of claim 2, wherein each of said shoulder straps further comprises a threaded buckle for releasably attaching said shoulder straps around said person's back and for adjusting the length of said shoulder straps.

4. The harness of claim 2, wherein said means for attaching further comprises a sternum strap adapted to extend around the sternum of said person.

5. The harness of claim 4, wherein said sternum strap further comprises a buckle for releasably attaching said sternum strap around the sternum of said person.

6. The harness of claim 5, wherein said sternum strap comprises first and second sections having first ends slidably attached to said shoulder straps and second ends attached to said buckle.

7. The harness of claim 2, wherein said means for attaching further comprises a diaphragm strap adapted to extend around the waist of said person.

8. The harness of claim 7, wherein said diaphragm strap further comprises a buckle for releasably attaching said diaphragm strap around the waist of said person.

9. The harness of claim 2, further comprising at least one stabilizer strap having a first end attached to a corresponding one of said shoulder straps and a second end for releasably attaching to a top surface of said case.

10. The harness of claim 9, wherein said stabilizer strap further comprises a fastener for releasably attaching to a handle mounted on said top surface of said case.

11. The harness of claim 10, wherein said fastener comprises a snap-hook clip.

12. The harness of claim 10, wherein said fastener further comprises a threaded section through which said stabilizer strap releasably slides to adjust the length of said stabilizer strap.

13. The harness of claim 2, further comprising a piece of grip-cloth attached to said front surface of said backpad to increase the coefficient of friction between said backpad and said case.

14. The harness of claim 1, wherein said first load strap further comprises a fastener for releasably attaching to a bolt mounted to said bottom surface of said case.

15. The harness of claim 14, wherein said fastener comprises a snap-hook clip.

16. The harness of claim 14, wherein said fastener further comprises a threaded section through which said first load strap releasably slides to adjust the length of said first load strap.

17. The harness of claim 1, wherein said second load strap secures said case using a handle mounted on said top surface of said case.

18. The harness of claim 17, wherein said second end of said second load strap releasably attaches to a middle portion of said upper load strap via a buckle.

19. The harness of claim 18, wherein said buckle comprises a side-release buckle having a threaded portion through which said second end of said second load strap adjustably slides.

20. The harness of claim 1, wherein said means for attaching comprises a waist strap adapted to extend around the waist of said person.

21. The harness of claim 20, wherein said waist strap comprises a buckle for releasably attaching around the waist of said person.

22. The harness of claim 21, wherein said buckle comprises a side-release buckle having a threaded portion allowing for adjustment of the length of said waist strap.

23. The harness of claim 20, wherein said second load strap has a first end attached to a lower portion of said backpad, and a second end for releasably attaching to a handle mounted on said top surface of said case.

24. The harness of claim 20, wherein said first load strap further comprises a fastener for releasably attaching to a bolt to said bottom surface of said case.

25. The harness of claim 24, wherein said fastener further comprises a snap-hook clip and includes a threaded section through which said first load strap releasably slides to adjust the length of said first load strap.

* * * * *